US011423822B2

(12) United States Patent
Park et al.

(10) Patent No.: US 11,423,822 B2
(45) Date of Patent: Aug. 23, 2022

(54) DISPLAY APPARATUS AND METHOD OF DRIVING DISPLAY PANEL USING THE SAME

(71) Applicant: Samsung Display Co., Ltd., Yongin-Si (KR)

(72) Inventors: Heesook Park, Suwon-si (KR); Kihyun Pyun, Gwangmyeong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/445,941

(22) Filed: Aug. 25, 2021

(65) Prior Publication Data

US 2022/0165200 A1 May 26, 2022

(30) Foreign Application Priority Data

Nov. 24, 2020 (KR) ..... 10-2020-0158483

(51) Int. Cl.
*G09G 3/20* (2006.01)

(52) U.S. Cl.
CPC ..... *G09G 3/2007* (2013.01); *G09G 2310/027* (2013.01); *G09G 2310/0232* (2013.01); *G09G 2310/0267* (2013.01); *G09G 2310/08* (2013.01); *G09G 2320/046* (2013.01)

(58) Field of Classification Search
CPC ..... G09G 3/2007; G09G 2310/0232; G09G 2310/0267; G09G 2310/027; G09G 2310/08; G09G 2320/046
See application file for complete search history.

(56) References Cited

U.S. PATENT DOCUMENTS

2016/0104445 A1* 4/2016 Hwang ..... G09G 3/3688 345/212
2016/0163287 A1* 6/2016 Ahn ..... G09G 3/3677 345/213
2018/0151146 A1* 5/2018 Chang ..... G09G 3/3688
2020/0013343 A1* 1/2020 Chiang ..... G09G 3/3614

FOREIGN PATENT DOCUMENTS

JP 2008-209885 A 9/2008
KR 10-0546593 B1 1/2006
KR 10-0844774 B1 7/2008

* cited by examiner

*Primary Examiner* — Andrew Sasinowski
(74) *Attorney, Agent, or Firm* — innovation Counsel LLP

(57) ABSTRACT

An embodiment of a display apparatus includes a display panel, a driving controller, and a data driver. In operation the driving controller determines a gain reducing area based on an edge load of input image data corresponding to an edge area of the display panel and compensates a grayscale value of the input image data corresponding to the gain reducing area to generate a data signal. The data driver converts the data signal to a data voltage and outputs the data voltage to the display panel.

20 Claims, 13 Drawing Sheets

FIG. 6

| | C1 | C2 | C3 | C4 | C5 | C6 | C7 | C8 | C9 | C10 | C11 | C12 | C13 | C14 | C15 | C16 |
|---|---|---|---|---|---|---|---|---|---|---|---|---|---|---|---|---|
| R1 | | | | | | | | | | | | | | | | |
| R2 | | | | | | | | | | | | | | | | |
| R3 | | | | | | | | | | | | | | | | |
| R4 | | | | | | | | | | | | | | | | |
| R5 | | | | | | | | | | | | | | | | |
| R6 | | | | | | | | | | | | | | | | |
| R7 | | | | | | | | | | | | | | | | |
| R8 | | | | | | | | | | | | | | | | |
| R9 | 10 | 10 | 30 | 30 | | | | | | | | | | | | |
| R10 | | | | | | | | | | | | | | | | |
| R11 | | | | | | | | | | | | | | | | |
| R12 | | | | | | | | | | | | | | | | |
| R13 | | | | | | | | | | | | | | | | |
| R14 | | | | | | | | | | | | | | | | |
| R15 | | | | | | | | | | | | | | | | |
| R16 | | | | | | | | | | | | | | | | |
| R17 | | | | | | | | | | | | | | | | |
| R18 | | | | | | | | | | | | | | | | |

OX1 CFX OX2

FIG. 7

| | C1 | C2 | C3 | C4 | C5 | C6 | C7 | C8 | C9 | C10 | C11 | C12 | C13 | C14 | C15 | C16 |
|---|---|---|---|---|---|---|---|---|---|---|---|---|---|---|---|---|
| R1 | | | | | | | | | | | | | | | | |
| R2 | | | | | | | | | | | | | | | | |
| R3 | | | | | | | | | | | | | | | | |
| R4 | | | | | | | | | | | | | | | | |
| R5 | | | | | | | | | | | | | | | | |
| R6 | | | | | | | | | | | | | | | | |
| R7 | | | | | | | | | | | | | | | | |
| R8 | | | | | | | | | | | | | | | | |
| R9 | 30 | 30 | 30 | 30 | | | | | | | | | | | | |
| R10 | | | | | | | | | | | | | | | | |
| R11 | | | | | | | | | | | | | | | | |
| R12 | | | | | | | | | | | | | | | | |
| R13 | | | | | | | | | | | | | | | | |
| R14 | | | | | | | | | | | | | | | | |
| R15 | | | | | | | | | | | | | | | | |
| R16 | | | | | | | | | | | | | | | | |
| R17 | | | | | | | | | | | | | | | | |
| R18 | | | | | | | | | | | | | | | | |

OX1 CFX OX2

FIG. 8

| | C1 | C2 | C3 | C4 | C5 | C6 | C7 | C8 | C9 | C10 | C11 | C12 | C13 | C14 | C15 | C16 |
|---|---|---|---|---|---|---|---|---|---|---|---|---|---|---|---|---|
| R1 | | | | | | | | | | | | | | | | |
| R2 | | | | | | | | | | | | | | | | |
| R3 | | | | | | | | | | | | | | | | |
| R4 | | | | | | | | | | | | | | | | |
| R5 | | | | | | | | | | | | | | | | |
| R6 | | | | | | | | | | | | | | | | |
| R7 | | | | | | | | | | | | | | | | |
| R8 | | | | | | | | | | | | | | | | |
| R9 | 30 | 10 | 10 | 10 | | | | | | | | | | | | |
| R10 | | | | | | | | | | | | | | | | |
| R11 | | | | | | | | | | | | | | | | |
| R12 | | | | | | | | | | | | | | | | |
| R13 | | | | | | | | | | | | | | | | |
| R14 | | | | | | | | | | | | | | | | |
| R15 | | | | | | | | | | | | | | | | |
| R16 | | | | | | | | | | | | | | | | |
| R17 | | | | | | | | | | | | | | | | |
| R18 | | | | | | | | | | | | | | | | |

OX1 CFX OX2

DISPLAY APPARATUS AND METHOD OF DRIVING DISPLAY PANEL USING THE SAME

PRIORITY STATEMENT

This application claims priority under 35 U.S.C. § 119 to Korean Patent Application No. 10-2020-0158483, filed on Nov. 24, 2020 in the Korean Intellectual Property Office KIPO, the contents of which are herein incorporated by reference in their entireties.

BACKGROUND

1. Field

The present inventive concept relates to a display apparatus and a method of driving a display panel using the display apparatus.

2. Description of the Related Art

Generally, a display apparatus includes a display panel and a display panel driver. The display panel displays an image based on input image data. The display panel includes a plurality of gate lines, a plurality of data lines and a plurality of pixels. The display panel driver includes a gate driver, a data driver and a driving controller. The gate driver outputs gate signals to the gate lines. The data driver outputs data voltages to the data lines. The driving controller controls the gate driver and the data driver.

A video producer's logo or a broadcaster's logo may be displayed in an edge area of the display panel. Since the logo is continuously displayed in the edge area, an afterimage due to the logo may remain in the edge area.

SUMMARY

In an embodiment of a display apparatus according to the present inventive concept, the display apparatus includes a display panel, a driving controller and a data driver. In operation, the driving controller determines a gain reducing area based on an edge load of input image data corresponding to an edge area of the display panel and compensates a grayscale value of the input image data corresponding to the gain reducing area to generate a data signal; and the data driver converts the data signal to a data voltage and outputs the data voltage to the display panel.

In an embodiment, the gain reducing area may be defined by gain reducing start points disposed at a first position and a second position in an axis.

In an embodiment, the gain reducing area may be defined by a first gain reducing start point disposed at a first position in a first axis, a second gain reducing start point disposed at a second position in the first axis, a third gain reducing start point disposed at a first position in a second axis crossing the first axis and a fourth gain reducing start point disposed at a second position in the second axis.

In an embodiment, the gain reducing area may be defined by the first to fourth gain reducing start points, a fifth gain reducing start point disposed at a first position in a third axis crossing the first axis and the second axis, a sixth gain reducing start point disposed at a second position in the third axis, a seventh gain reducing start point disposed at a first position in a fourth axis crossing the first axis, the second axis and the third axis, and an eighth gain reducing start point disposed at a second position in the fourth axis. The first axis may be parallel to a first side of the display panel, the second axis may be parallel to a second side of the display panel, the third axis may extend in a first diagonal line direction of the display panel, and the fourth axis may extend in a second diagonal line direction of the display panel.

In an embodiment, the driving controller may be configured to determine a display block having a load less than a threshold from a first end outermost display block in a first end edge area disposed at a first end portion of the axis. The driving controller may be configured to determine first continuous display blocks that have loads less than the threshold from the first end outermost display block. An innermost display block in the first continuous display blocks may be determined as the gain reducing start point at the first position of the axis.

In an embodiment, the driving controller may be configured to determine a display block having a load less than the threshold from a second end outermost display block in a second end edge area disposed at a second end portion of the axis. The driving controller may be configured to determine second continuous display blocks that have loads less than the threshold from the second end outermost display block. An innermost display block in the second continuous display blocks may be determined as the gain reducing start point at the second position of the axis.

In an embodiment, as the edge load of the input image data increases, a size of the gain reducing area may be decreased.

In an embodiment, the driving controller may be configured to determine a minimum gain applied to an outermost display block based on an edge motion amount of the input image data corresponding to a motion edge area of the display panel and to compensate the grayscale value of the input image data using the gain reducing area and the minimum gain to generate the data signal.

In an embodiment, the edge motion amount may correspond to a difference between a sum of loads of the input image data corresponding to the motion edge area in an N−1-th frame and a sum of loads of the input image data corresponding to the motion edge area in an N-th frame. N may be a positive integer greater than two.

In an embodiment, as the edge motion amount of the input image data increases, the minimum gain may be decreased.

In an embodiment, the edge area for determining the gain reducing area may be different from the motion edge area for determining the edge motion amount.

In an embodiment, the edge area may be greater than the motion edge area.

In an embodiment of a display apparatus according to the present inventive concept, the display apparatus includes a display panel, a driving controller and a data driver. In operation, the driving controller determines a minimum gain applied to an outermost display block based on an edge motion amount of input image data corresponding to a motion edge area of the display panel and compensates a grayscale value of the input image data using the minimum gain to generate a data signal; and the data driver converts the data signal to a data voltage and outputs the data voltage to the display panel.

In an embodiment, the edge motion amount may correspond to a difference between a sum of loads of the input image data corresponding to the motion edge area in an N−1-th frame and a sum of loads of the input image data corresponding to the motion edge area in an N-th frame. N is a positive integer greater than two.

In an embodiment, as the edge motion amount of the input image data increases, the minimum gain may be decreased.

In an embodiment of a method of driving a display panel according to the present inventive concept, the method includes calculating an edge load of input image data corresponding to an edge area of the display panel, determining a gain reducing area based on the edge load, compensating a grayscale value of the input image data corresponding to the gain reducing area to generate a data signal and converting the data signal to a data voltage.

In an embodiment, the gain reducing area may be defined by gain reducing start points disposed at a first position and a second position in an axis.

In an embodiment, as the edge load of the input image data increases, a size of the gain reducing area may be decreased.

In an embodiment, the method may further include calculating an edge motion amount of the input image data corresponding to a motion edge area of the display panel and determining a minimum gain applied to an outermost display block based on the edge motion amount. The grayscale value of the input image data may be compensated using the gain reducing area and the minimum gain to generate the data signal.

In an embodiment, as the edge motion amount of the input image data increases, the minimum gain may be decreased.

According to the display apparatus and the method of driving the display panel, the size of the gain reducing area may be adjusted according to the load of the input image data corresponding to the edge area of the display panel. In addition, the size of the gain reducing area may be determined based on a plurality of axes so that a shape of the gain reducing area may vary according to the load of the input image data.

In addition, the minimum gain corresponding to the outermost block of the edge area of the display panel may vary according to the amount of the motion of the input image data corresponding to the edge area.

The size of the gain reducing area and the minimum gain may be determined based on the load and the amount of the motion of the input image data corresponding to the edge area of the display panel so that the edge area of the display panel may be properly compensated. Accordingly, the after-image due to the logo displayed in the edge area may be reduced. Thus, the display quality of the display panel may be enhanced.

BRIEF DESCRIPTION OF THE DRAWINGS

The above and other features and advantages of the present inventive concept will become more apparent by describing in detailed embodiments thereof with reference to the accompanying drawings, in which:

FIG. 6 is a conceptual diagram illustrating an example of a method of determining the first gain reducing start point in the first axis;

FIG. 7 is a conceptual diagram illustrating an example of a method of determining the first gain reducing start point in the first axis;

FIG. 8 is a conceptual diagram illustrating an example of a method of determining the first gain reducing start point in the first axis;

DETAILED DESCRIPTION OF THE INVENTIVE CONCEPT

Hereinafter, the present inventive concept will be explained in detail with reference to the accompanying drawings.

Embodiments of the present inventive concept provide a display apparatus adjusting a luminance of an edge area of a display panel according to a load and an amount of motion of input image data corresponding to the edge area. Embodiments of the present inventive concept also provide a method of driving a display panel using the display apparatus.

Figure 1:
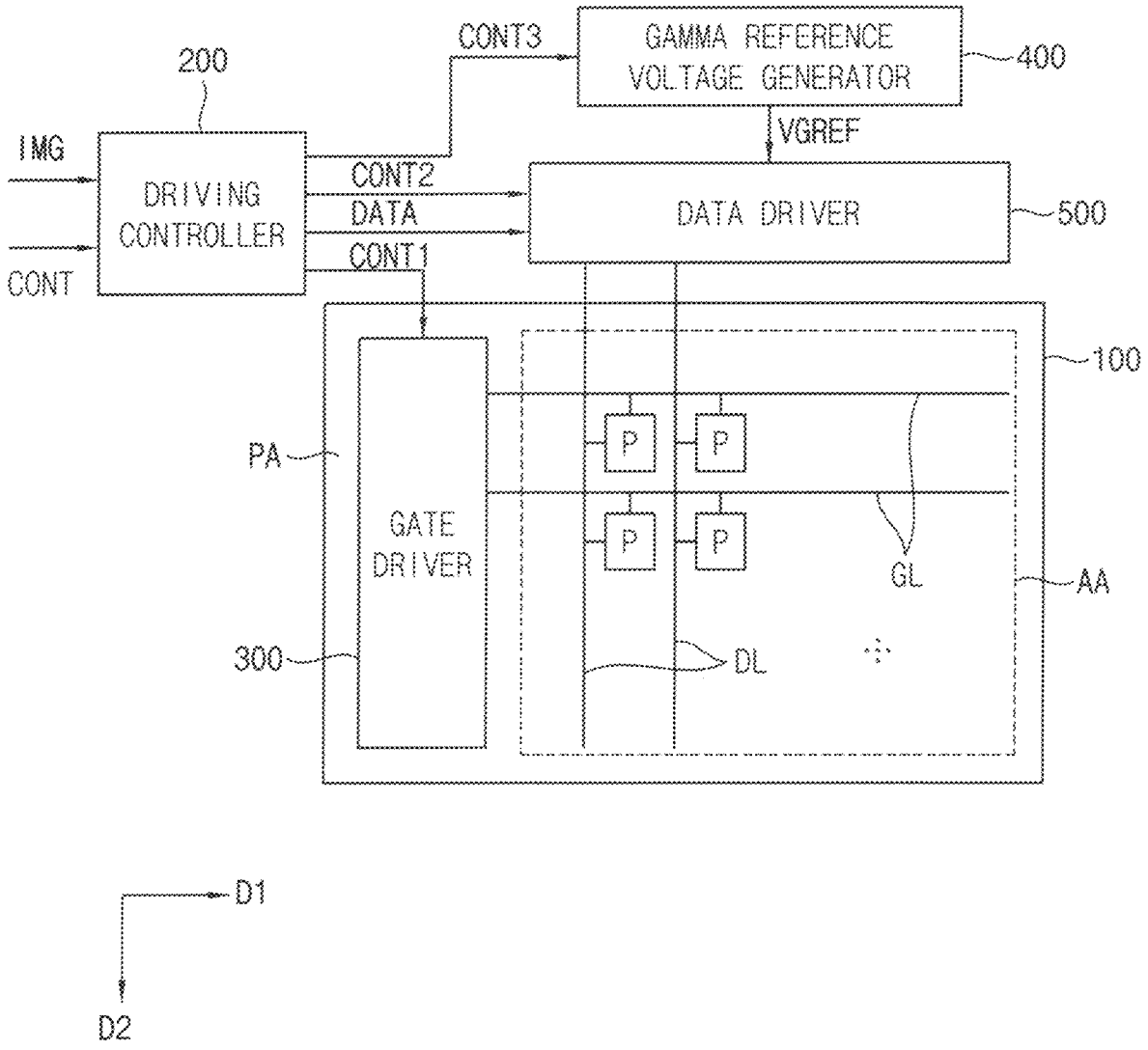
FIG. 1 is a block diagram illustrating a display apparatus according to an embodiment of the present inventive concept.

FIG. 1 is a block diagram illustrating a display apparatus according to an embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500.

For example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 which are integrally formed may be called to a timing controller embedded data driver (TED).

The display panel 100 has a display region on which an image is displayed and a peripheral region adjacent to the display region.

The display panel 100 includes a plurality of gate lines GL, a plurality of data lines DL and a plurality of pixels P connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

A structure and an operation of the driving controller 200 are explained referring to FIGS. 2 to 18 in detail.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. For example, the gate driver 300 may be mounted on the peripheral region of the display panel 100. For example, the gate driver 300 may be integrated on the peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
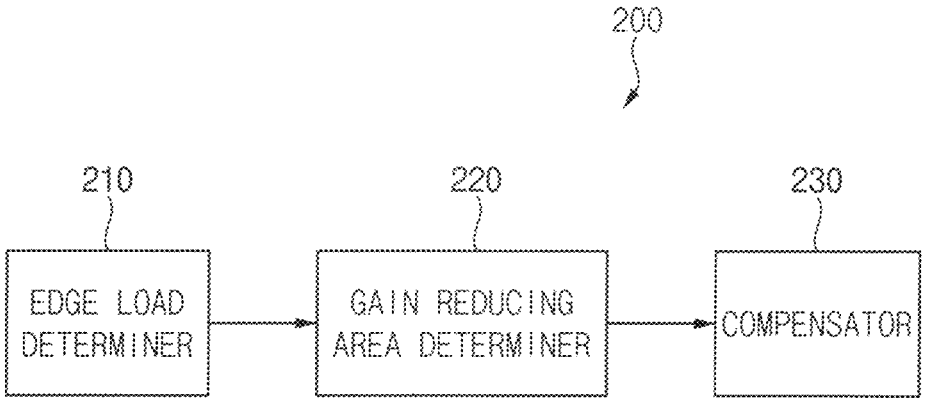
FIG. 2 is a block diagram illustrating a driving controller of FIG. 1.
Figure 3:
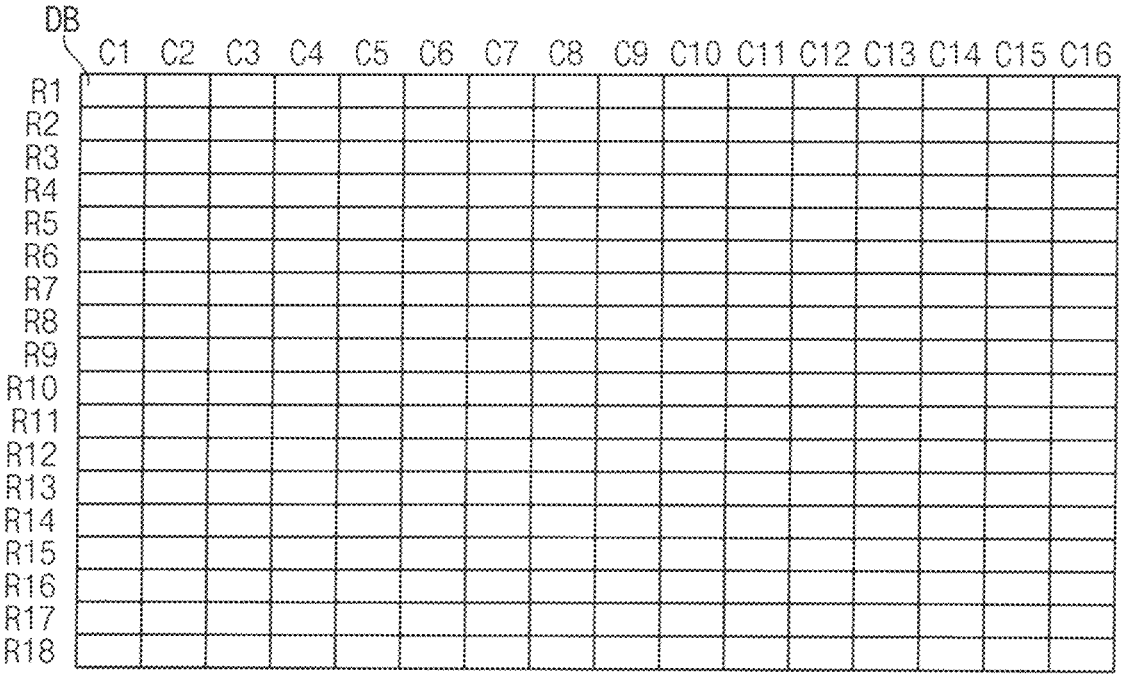
FIG. 3 is a conceptual diagram illustrating a display panel of FIG. 1.
Figure 4:
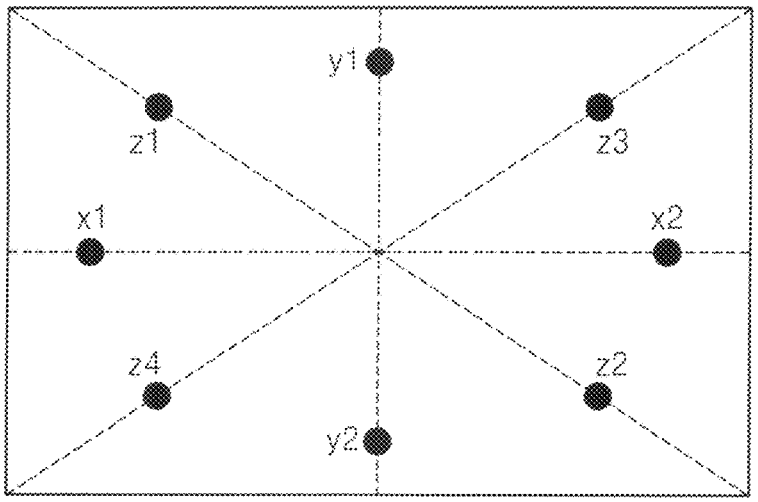
FIG. 4 is a conceptual diagram illustrating a gain reducing start point determined by the driving controller of FIG. 1.

FIG. 2 is a block diagram illustrating the driving controller 200 of FIG. 1. FIG. 3 is a conceptual diagram illustrating the display panel 100 of FIG. 1. FIG. 4 is a conceptual diagram illustrating a gain reducing start point determined by the driving controller 200 of FIG. 1.

Referring to FIGS. 1 to 4, the driving controller 200 may determine a gain reducing area based on an edge load of the input image data IMG corresponding to an edge area of the display panel 100. The driving controller 200 may compensate the grayscale value of the input image data based on the gain reducing area to generate the data signal DATA. The gain reducing area may refer to an area in which a gain less than one is applied to the grayscale value (or the luminance) of the input image data IMG to reduce the grayscale value (or the luminance) of the input image data IMG.

For example, the driving controller 200 may include an edge load calculator 210 calculating the edge load of the input image data IMG corresponding to the edge area of the display panel 100, a gain reducing area determiner 220 determining the gain reducing area based on the edge load and a compensator compensating the grayscale value of the input image data IMG corresponding to the gain reducing area.

As shown in FIG. 3, the display panel 100 may include a plurality of display blocks DB. The display blocks DB may be defined by a plurality of display block rows R1 to R18 and a plurality of display block columns C1 to C16.

Although the display panel 100 includes eighteen display block rows and sixteen display block columns in the present embodiment, the present inventive concept may not be limited to the number of the display block rows and the number of the display block columns.

For example, when the driving controller 200 calculates the edge load of the input image data IMG, the driving controller 200 may calculate the edge load in a unit of the display block.

In FIG. 4, the gain reducing area may be defined by gain reducing start points disposed at first positions and second positions in axes.

For example, the gain reducing area may be defined by a first gain reducing start point x1 disposed at a first position in a first axis (an x-axis), a second gain reducing start point x2 disposed at a second position in the first axis (the x-axis), a third gain reducing start point y1 disposed at a first position in a second axis (a y-axis) crossing the first axis (the x-axis)

and a fourth gain reducing start point y2 disposed at a second position in the second axis (the y-axis).

The size and the shape of the gain reducing area may be adjusted according to the positions of the first to fourth gain reducing start points x1, x2, y1 and y2.

For example, the gain reducing area may be defined by the first to fourth gain reducing start points x1, x2, y1 and y2, a fifth gain reducing start point z1 disposed at a first position in a third axis (a first diagonal axis) crossing the first axis (the x-axis) and the second axis (the y-axis), a sixth gain reducing start point z2 disposed at a second position in the third axis (the first diagonal axis), a seventh gain reducing start point z3 disposed at a first position in a fourth axis (a second diagonal axis) crossing the first axis (the x-axis), the second axis (the y-axis) and the third axis (the first diagonal axis), and an eighth gain reducing start point z4 disposed at a second position in the fourth axis (the second diagonal axis).

For example, the first axis may be parallel to a first side (e.g. a horizontal side) of the display panel 100. For example, the second axis may be parallel to a second side (e.g. a vertical side) of the display panel 100. For example, the third axis may extend in a first diagonal line direction of the display panel 100. For example, the fourth axis may extend in a second diagonal line direction of the display panel 100.

Figure 5:
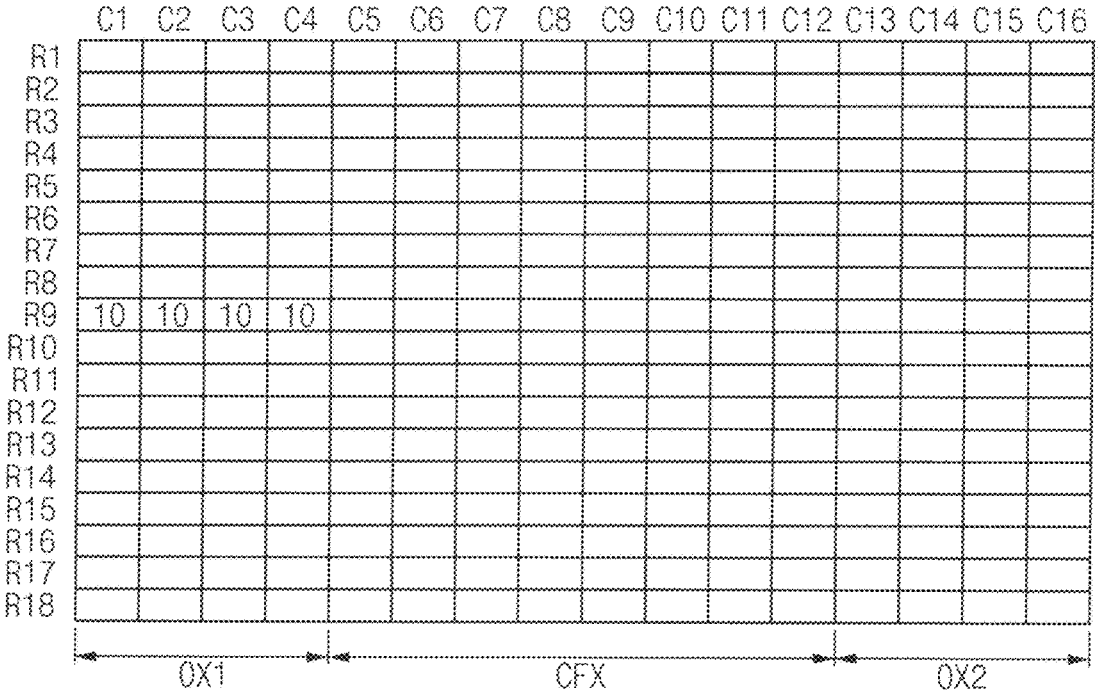
FIG. 5 is a conceptual diagram illustrating an example of a method of determining a first gain reducing start point in a first axis.

FIG. 5 is a conceptual diagram illustrating an example of a method of determining a first gain reducing start point in a first axis. FIG. 6 is a conceptual diagram illustrating an example of a method of determining the first gain reducing start point in the first axis. FIG. 7 is a conceptual diagram illustrating an example of a method of determining the first gain reducing start point in the first axis. FIG. 8 is a conceptual diagram illustrating an example of a method of determining the first gain reducing start point in the first axis.

Referring to FIGS. 1 to 8, the display panel 100 may include a first end edge area OX1 disposed at a first end portion of the axis (e.g. the x-axis), a second end edge area OX2 disposed at a second end portion of the axis (e.g. the x-axis) and a central area CFX disposed between the first end edge area OX1 and the second end edge area OX2.

The driving controller 200 may determine a display block having a load less than a threshold from a first end outermost display block (a block R9-C1) in the first end edge area OX1 disposed at the first end portion of the axis (e.g. the x-axis). The driving controller 200 may determine first continuous display blocks that have loads less than the threshold from the first end outermost display block (the block R9-C1). An innermost display block in the first continuous display blocks may be determined as a gain reducing start point in the first position of the axis. In FIGS. 5 to 8, the threshold may be 20.

In FIG. 5, the first continuous display blocks that have loads less than the threshold (e.g. 20) from the first end outermost display block (the block R9-C1) may include a block R9-C1, a block R9-C2, a block R9-C3 and a block R9-C4. Herein, the driving controller 200 may determine the innermost block R9-C4 in the first continuous display blocks R9-C1, R9-C2, R9-C3 and R9-C4 as the gain reducing start point x1 in the first position of the axis. When the gain reducing start point x1 is the block R9-C4, a gain reducing compensation may be applied to the blocks R9-C1, R9-C2, R9-C3 and R9-C4 in the first end edge area OX1.

In FIG. 6, the first continuous display blocks that have loads less than the threshold (e.g. 20) from the first end outermost display block (the block R9-C1) may include a block R9-C1 and a block R9-C2. Herein, the driving controller 200 may determine the innermost block R9-C2 in the first continuous display blocks R9-C1 and R9-C2 as the gain reducing start point x1 in the first position of the axis. When the gain reducing start point x1 is the block R9-C2, the gain reducing compensation may be applied to the blocks R9-C1 and R9-C2 in the first end edge area OX1.

In FIG. 7, the first continuous display blocks that have loads less than the threshold (e.g. 20) from the first end outermost display block (the block R9-C1) may not exist since the first end outermost display block (the block R9-C1) has a load greater than the threshold. Herein, the gain reducing compensation may not be applied to any blocks in the first end edge area OX1.

In FIG. 8, the first continuous display blocks that have loads less than the threshold (e.g. 20) from the first end outermost display block (the block R9-C1) may not exist since the first end outermost display block (the block R9-C1) has a load greater than the threshold although the blocks R9-C2, R9-C3 and R9-C4 have loads greater than the threshold. Herein, the gain reducing compensation may not be applied to any blocks in the first end edge area OX1 like FIG. 7.

In FIGS. 5 to 8, the method of determining the first gain reducing start point x1 in the first edge area OX1 of the x-axis has been explained. A second gain reducing start point x2 in the second edge area OX2 of the x-axis may be determined in the same method for determining the first gain reducing start point x1 in the first edge area OX1.

For example, the driving controller 200 may determine a display block having a load less than the threshold from the second end outermost display block (a block R9-C16) in the second end edge area OX2 disposed at the second end portion of the axis (e.g. the x-axis). The driving controller 200 may determine second continuous display blocks that have loads less than the threshold from the second end outermost display block (the block R9-C16). An innermost display block in the second continuous display blocks may be determined as a gain reducing start point in the second position of the axis.

In FIGS. 5 to 8, the method of determining the first gain reducing start point x1 in the first edge area OX1 of the x-axis has been explained. The second gain reducing start point x2 in a second edge area OX2 of the x-axis, third and fourth gain reducing start points y1 and y2 in the y-axis, fifth and sixth gain reducing start points z1 and z2 in the first diagonal axis and seventh and eighth gain reducing start points z3 and z4 in the second diagonal axis may be determined in the same method for determining the first gain reducing start point x1 in the first edge area OX1.

Although the first gain reducing start point x1 and the second gain reducing start point x2 are determined in the ninth display block row (a central display block row), the present inventive concept may not limited thereto. The first gain reducing start point x1 and the second gain reducing start point x2 may be determined in plural display block rows (e.g. eighth, ninth and tenth display block rows or seventh, eighth, ninth, tenth and eleventh display block rows) including the ninth display block row (the central display block row).

Similarly, the third gain reducing start point y1 and the fourth gain reducing start point y2 are determined in an eighth display block column (a central display block column). Alternatively, the third gain reducing start point y1 and the fourth gain reducing start point y2 may be determined in plural display block columns (e.g. seventh, eighth and ninth display block columns or sixth, seventh, eighth, ninth and tenth display block columns) including the eighth display block column (the central display block column).

Figure 9:
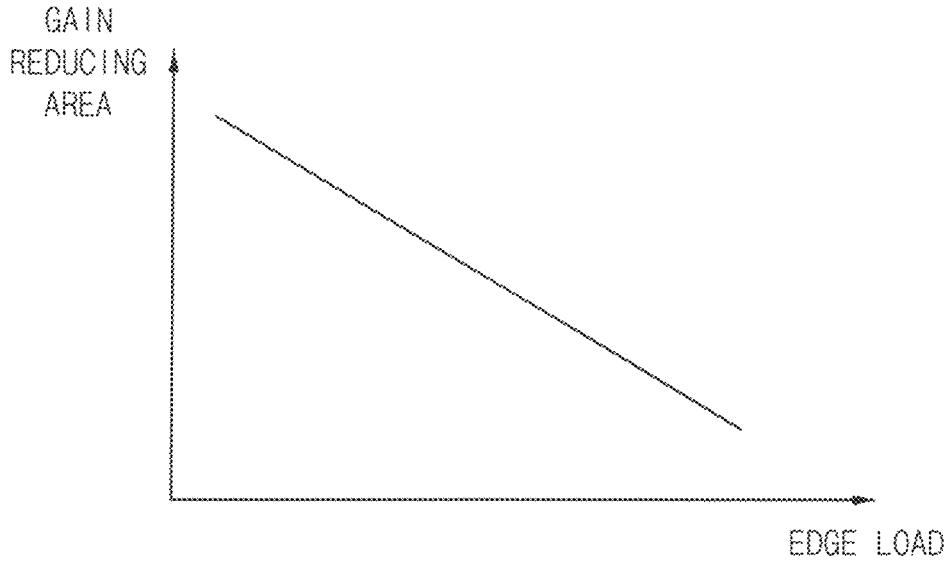
FIG. 9 is a graph illustrating a size of a gain reducing area according to a load of input image data corresponding to an edge area of the display panel of FIG. 1.
Figure 10:
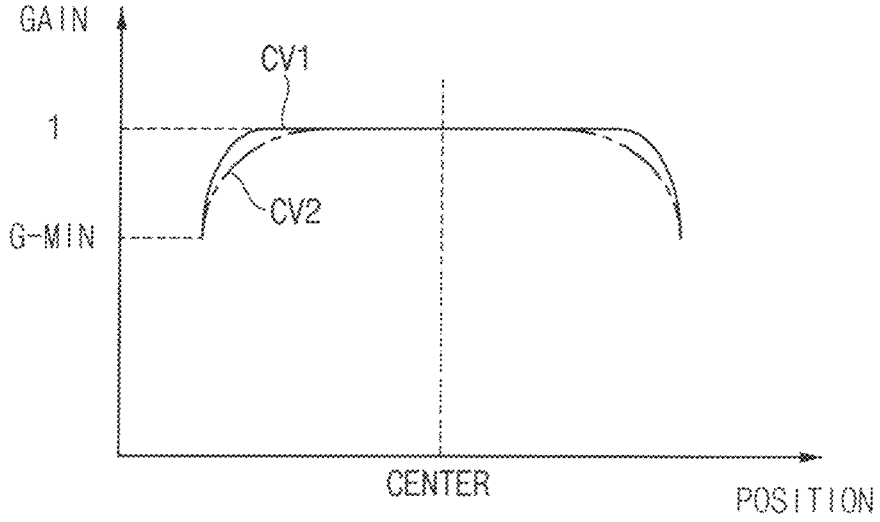
FIG. 10 is a graph illustrating a gain according to a position in the display panel of FIG. 1.
Figure 11:
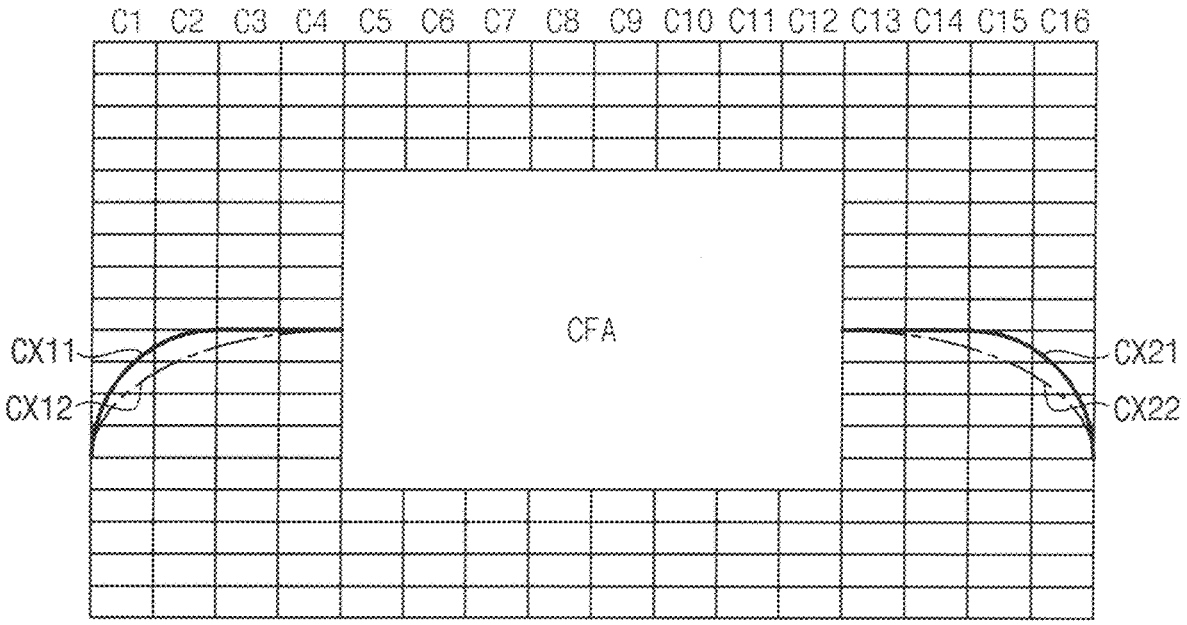
FIG. 11 is a conceptual diagram illustrating a gain according to a position in the first axis in the display panel of FIG. 1.
Figure 12:
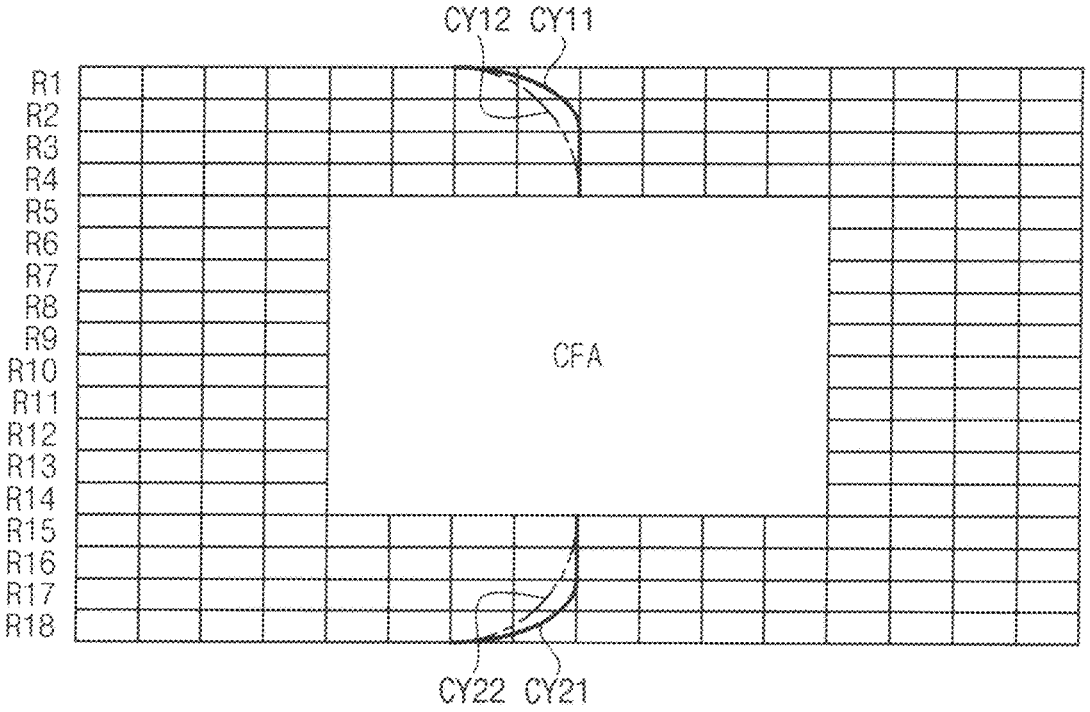
FIG. 12 is a conceptual diagram illustrating a gain according to a position in a second axis in the display panel of FIG. 1.
Figure 13:
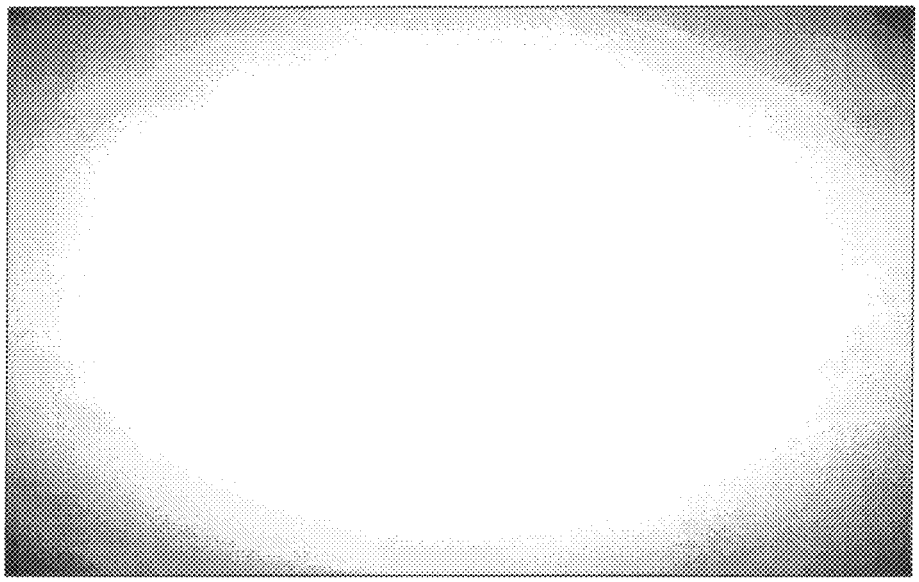
FIG. 13 is a conceptual diagram illustrating an example of the gain reducing area determined by the driving controller of FIG. 1.
Figure 14:
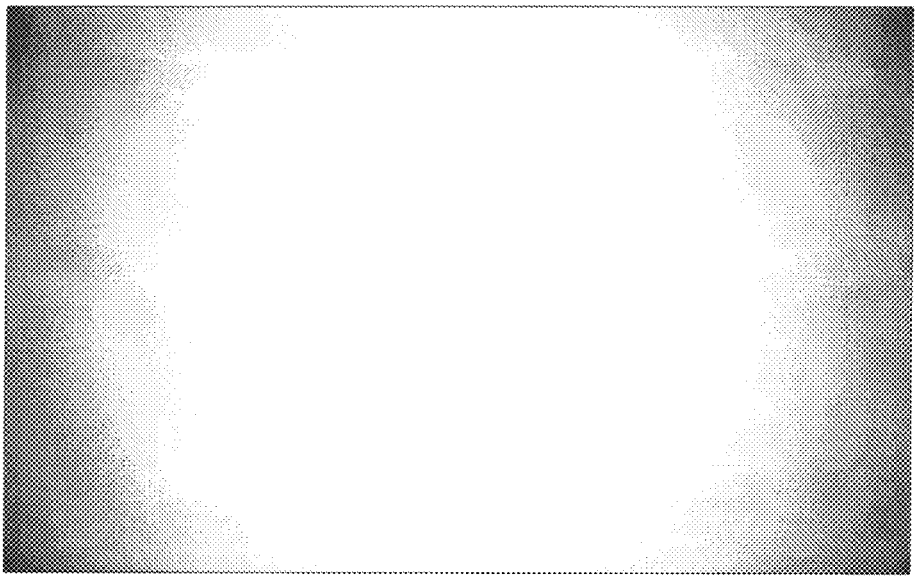
FIG. 14 is a conceptual diagram illustrating an example of the gain reducing area determined by the driving controller of FIG. 1.
Figure 15:
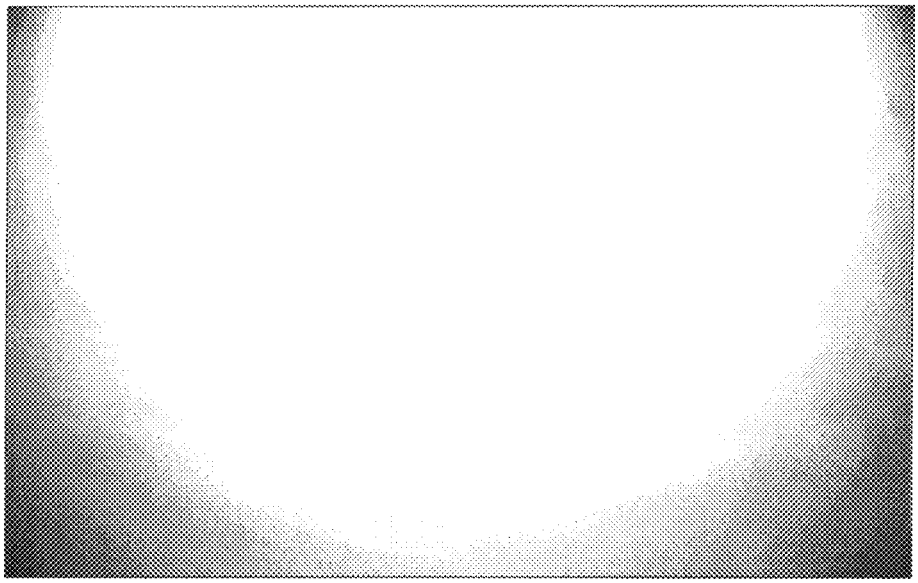
FIG. 15 is a conceptual diagram illustrating an example of the gain reducing area determined by the driving controller of FIG. 1.
Figure 16:
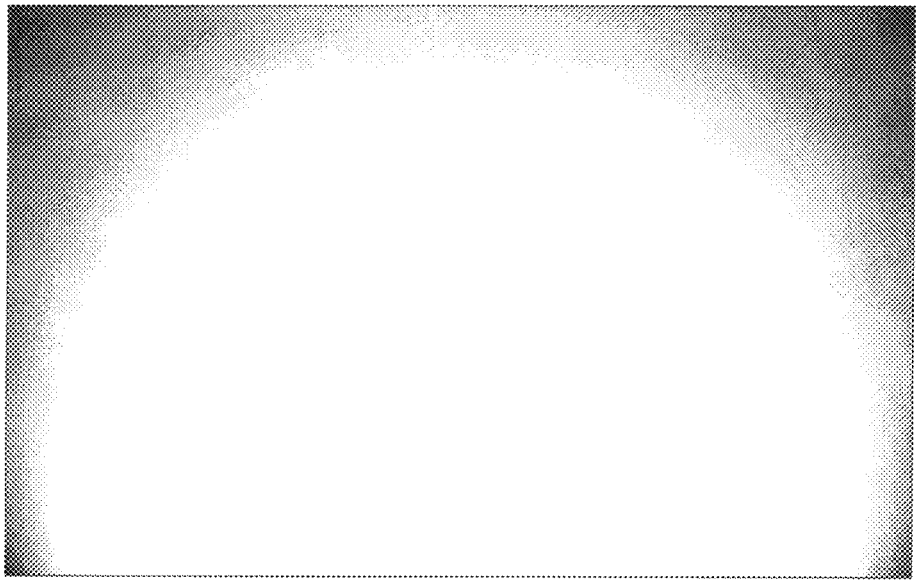
FIG. 16 is a conceptual diagram illustrating an example of the gain reducing area determined by the driving controller of FIG. 1.
Figure 17:
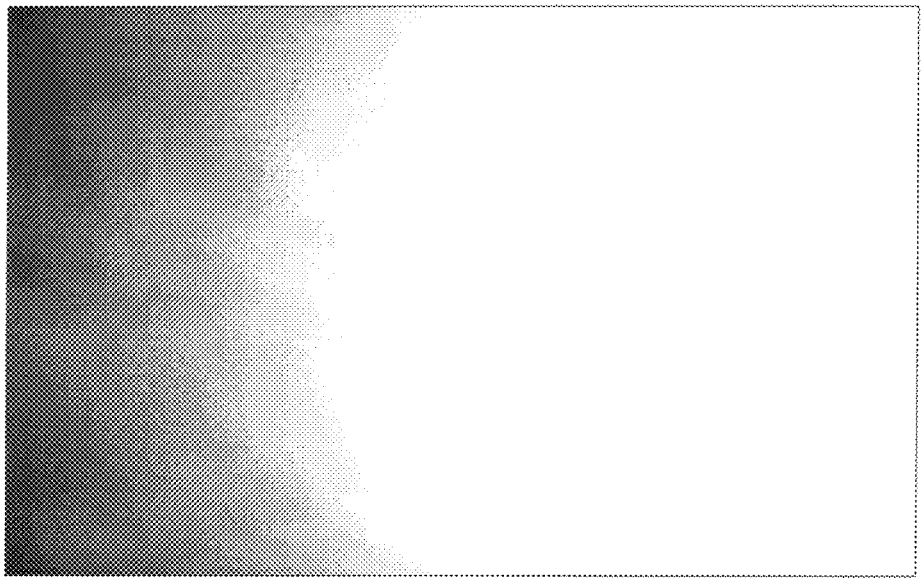
FIG. 17 is a conceptual diagram illustrating an example of the gain reducing area determined by the driving controller of FIG. 1.
Figure 18:
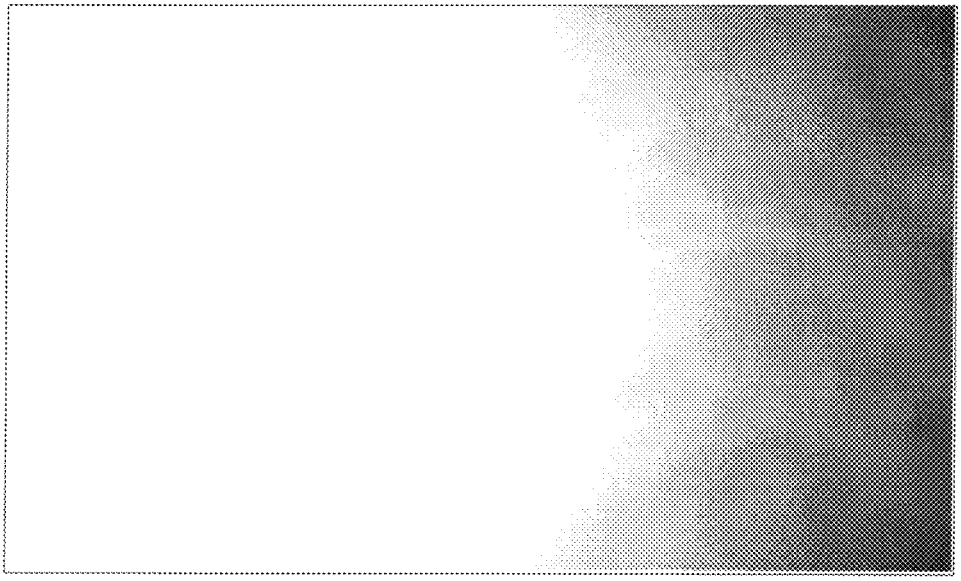
FIG. 18 is a conceptual diagram illustrating an example of the gain reducing area determined by the driving controller of FIG. 1.

FIG. 9 is a graph illustrating a size of a gain reducing area according to a load of input image data corresponding to an edge area of the display panel 100 of FIG. 1. FIG. 10 is a graph illustrating a gain according to a position in the display panel 100 of FIG. 1. FIG. 11 is a conceptual diagram illustrating a gain according to a position in the first axis in the display panel 100 of FIG. 1. FIG. 12 is a conceptual diagram illustrating a gain according to a position in a second axis in the display panel 100 of FIG. 1. FIG. 13 is a conceptual diagram illustrating an example of the gain reducing area determined by the driving controller 200 of FIG. 1. FIG. 14 is a conceptual diagram illustrating an example of the gain reducing area determined by the driving controller 200 of FIG. 1. FIG. 15 is a conceptual diagram illustrating an example of the gain reducing area determined by the driving controller 200 of FIG. 1. FIG. 16 is a conceptual diagram illustrating an example of the gain reducing area determined by the driving controller 200 of FIG. 1. FIG. 17 is a conceptual diagram illustrating an example of the gain reducing area determined by the driving controller 200 of FIG. 1. FIG. 18 is a conceptual diagram illustrating an example of the gain reducing area determined by the driving controller 200 of FIG. 1.

As shown in FIG. 9, as the edge load of the input image data IMG increases, the size of the gain reducing area may be decreased. When the edge load is great, it means that a visibility of the edge area is great. Thus, when the edge load is great, it is preferable to reduce the size of the gain reducing area. In contrast, when the edge load is low, it means that a visibility of the edge area is low. Thus, when the edge load is low, it is preferable to enlarge the size of the gain reducing area.

In FIG. 10, a first curve CV1 represents a case the gain reducing area is relatively small and a second curve CV2 represents a case the gain reducing area is relatively large. In FIG. 10, the minimum gain G-MIN, which means the gain of the outermost display block, may be the same for the first curve CV1 and the second curve CV2.

In FIGS. 11 and 12, CFA may be a gain fixed area where gain reducing is not applied. A gain of 1 may be applied to the input image data IMG corresponding to the gain fixed area. Applying the gain of 1 may mean that the grayscale value (or the luminance) of the input image data IMG is not compensated.

In FIG. 11, a curve CX11 represents a case that the gain reducing area is relatively small in a first end portion of the x-axis and a curve CX12 represents a case that the gain reducing area is relatively large in the first end portion of the x-axis.

In the curve CX11, the first gain reducing start point x1 may be a second display block column C2. In the curve CX12, the first gain reducing start point x1 may be a third display block column C3.

In FIG. 11, a curve CX21 represents a case that the gain reducing area is relatively small in a second end portion of the x-axis and a curve CX22 represents a case that the gain reducing area is relatively large in the second end portion of the x-axis.

In the curve CX21, the second gain reducing start point x2 may be a fifteenth display block column C15. In the curve CX22, the second gain reducing start point x2 may be a fourteenth display block column C14.

In FIG. 12, a curve CY11 represents a case that the gain reducing area is relatively small in a first end portion of the y-axis and a curve CY12 represents a case that the gain reducing area is relatively large in the first end portion of the y-axis.

In FIG. 12, a curve CY21 represents a case that the gain reducing area is relatively small in a second end portion of the y-axis and a curve CY22 represents a case that the gain reducing area is relatively large in the second end portion of the y-axis.

FIG. 13 represents a gain reducing area pattern defined by the first to eighth gain reducing start points x1, x2, y1, y2, z1, z2, z3 and z4 has an oval shape. A bright portion in FIG. 13 has a gain of 1 and dark portion in FIG. 13 has a gain less than 1.

FIG. 14 represents a gain reducing area pattern defined by the first to eighth gain reducing start points x1, x2, y1, y2, z1, z2, z3 and z4 has a circular shape.

FIG. 15 represents a gain reducing area pattern defined by the first to eighth gain reducing start points x1, x2, y1, y2, z1, z2, z3 and z4 has a semicircular shape rounded downward.

FIG. 16 represents a gain reducing area pattern defined by the first to eighth gain reducing start points x1, x2, y1, y2, z1, z2, z3 and z4 has a semicircular shape rounded upward.

FIG. 17 represents a gain reducing area pattern defined by the first to eighth gain reducing start points x1, x2, y1, y2, z1, z2, z3 and z4 has a semicircular shape rounded to a right side.

FIG. 18 represents a gain reducing area pattern defined by the first to eighth gain reducing start points x1, x2, y1, y2, z1, z2, z3 and z4 has a semicircular shape rounded to a left side.

According to the present embodiment, the size of the gain reducing area may be adjusted according to the load of the input image data IMG corresponding to the edge area of the display panel 100. In addition, the size of the gain reducing area may be determined based on a plurality of axes so that the shape of the gain reducing area may vary according to the load of the input image data IMG.

The size of the gain reducing area may be determined based on the load of the input image data corresponding to the edge area of the display panel 100 so that the edge area of the display panel 100 may be properly compensated. Accordingly, the afterimage due to the logo displayed in the edge area may be reduced. Thus, the display quality of the display panel 100 may be enhanced.

Figure 19:
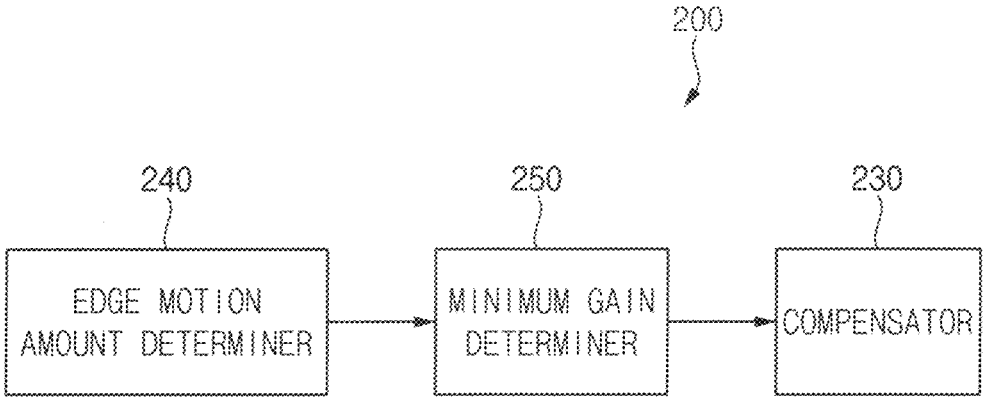
FIG. 19 is a block diagram illustrating a driving controller of a display apparatus according to an embodiment of the present inventive concept.
Figure 20:
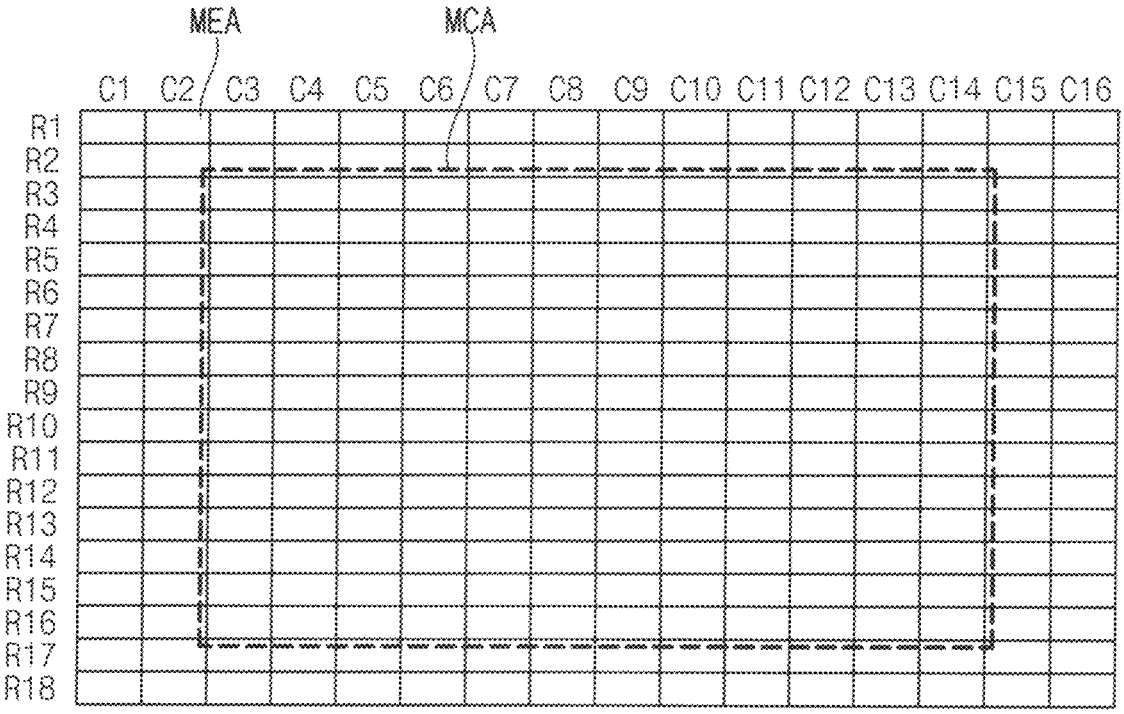
FIG. 20 is a conceptual diagram illustrating a display panel of FIG. 19.
Figure 21:
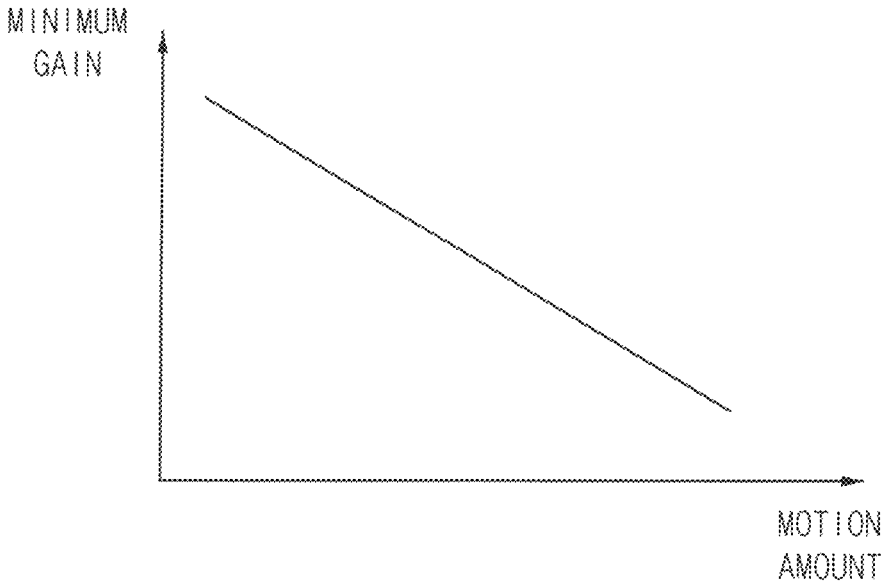
FIG. 21 is a graph illustrating a minimum gain according to an amount of motion of input image data corresponding to an edge area of the display panel of FIG. 19.
Figure 22:
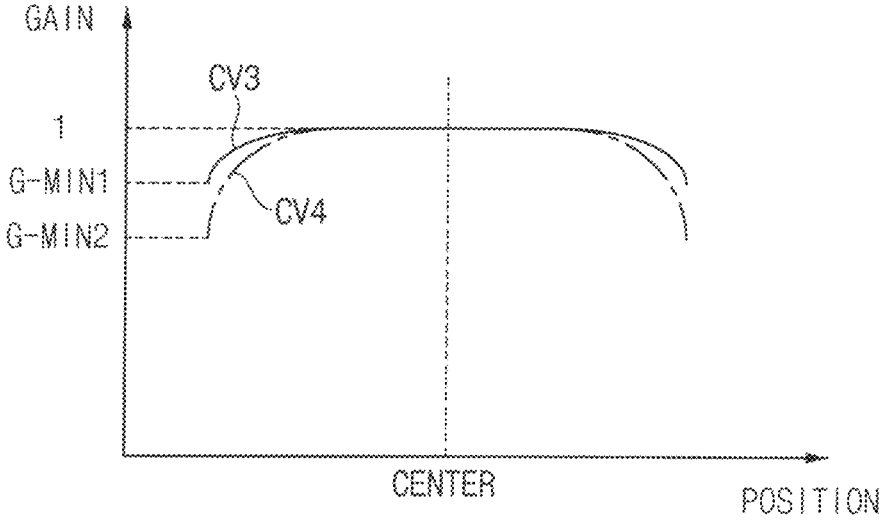
FIG. 22 is a graph illustrating a gain according to a position in the display panel of FIG. 19.

FIG. 19 is a block diagram illustrating a driving controller 200 of a display apparatus according to an embodiment of the present inventive concept. FIG. 20 is a conceptual diagram illustrating a display panel 100 of FIG. 19. FIG. 21 is a graph illustrating a minimum gain according to an amount of motion of input image data IMG corresponding to an edge area of the display panel 100 of FIG. 19. FIG. 22 is a graph illustrating a gain according to a position in the display panel 100 of FIG. 19.

The display apparatus and the method of driving the display panel according to the present embodiment is substantially the same as the display apparatus and the method of driving the display panel of the previous embodiment explained referring to FIGS. 1 to 18 except for the structure and the operation of the driving controller. Thus, the same reference numerals will be used to refer to the same or like parts as those described in the previous embodiment of FIGS. 1 to 18 and any repetitive explanation concerning the above elements will be omitted.

Referring to FIGS. 1 and 19 to 22, the display apparatus includes a display panel 100 and a display panel driver. The display panel driver includes a driving controller 200, a gate driver 300, a gamma reference voltage generator 400 and a data driver 500.

The driving controller 200 may determine a minimum gain applied to an outermost display block based on an edge motion amount of the input image data IMG corresponding to a motion edge area MEA of the display panel 100. The driving controller 200 may compensate a grayscale value of the input image data IMG using the minimum gain to generate the data signal DATA. An area considered to determine the edge motion amount may be the motion edge area MEA of the display panel 100. An area not considered to determine the edge motion amount is a central area MCA of the display panel 100 surrounded by the motion edge area MEA.

For example, the driving controller 200 may include a edge motion amount calculator 240 calculating the edge motion amount of the input image data IMG corresponding to the motion edge area MEA of the display panel 100, a minimum gain determiner 250 determining the minimum gain applied to the outermost display block based on the edge motion amount and a compensator compensating the grayscale value of the input image data IMG using the minimum gain.

Similar to the explanation in FIG. 4, the driving controller 200 may determine a first minimum gain in a first position in an x-axis, a second minimum gain in a second position in the x-axis, a third minimum gain in a first position in a y-axis, a second minimum gain in a second position in the y-axis, a fifth minimum gain in a first position in a first diagonal axis, a sixth minimum gain in a second position in the first diagonal axis, a seventh minimum gain in a first position in a second diagonal axis and an eighth minimum gain in a second position in the second diagonal axis.

The edge motion amount may correspond to a difference between a sum of loads of the input image data IMG corresponding to the motion edge area MEA in an N−1-th frame and a sum of loads of the input image data IMG corresponding to the motion edge area MEA in an N-th frame.

Alternatively, the edge motion amount may correspond to a sum of differences between display block loads of the input image data IMG corresponding to display blocks in the motion edge area MEA in the N−1-th frame and display block loads of the input image data IMG corresponding to the display blocks in the motion edge area MEA in the N-th frame.

As shown in FIG. 21, as the edge motion amount MOTION AMOUNT of the input image data IMG increases, the minimum gain may be decreased. When the edge motion amount MOTION AMOUNT is low, it means that a visibility of the edge area is great. Thus, when the edge motion amount MOTION AMOUNT is low, it is preferable not to reduce the minimum gain much. In contrast, when the edge motion amount MOTION AMOUNT is great, it means that a visibility of the edge area is low. Thus, when the edge motion amount MOTION AMOUNT is great, the minimum gain may be reduced relatively much.

In FIG. 22, a third curve CV3 represents a case the minimum gain is a first minimum gain G-MIN1 which is greater than a second minimum gain G-MIN2 and a fourth curve CV4 represents a case the minimum gain is the second minimum gain G-MIN2. The third curve CV3 may represent a case the edge motion amount is low and the fourth curve CV3 may represent a case the edge motion amount is great. In FIG. 22, the size of the gain reducing area may be the same for the third curve CV3 and the fourth curve CV4.

According to the present embodiment, the minimum gain corresponding to the outermost block of the edge area of the display panel 100 may vary according to the amount of the motion of the input image data IMG corresponding to the edge area.

The minimum gain may be determined based on the amount of the motion of the input image data IMG corresponding to the edge area of the display panel 100 so that the edge area of the display panel 100 may be properly compensated. Accordingly, the afterimage due to the logo displayed in the edge area may be reduced. Thus, the display quality of the display panel 100 may be enhanced.

Figure 23:
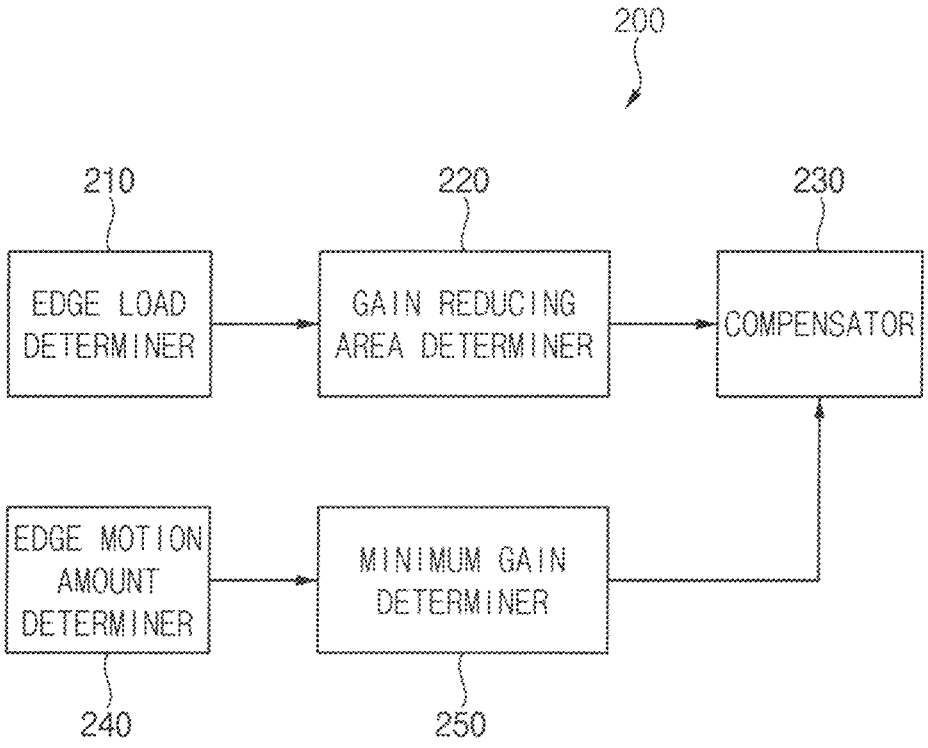
FIG. 23 is a block diagram illustrating a driving controller of a display apparatus according to an embodiment of the present inventive concept.

FIG. 23 is a block diagram illustrating a driving controller 200 of a display apparatus according to an embodiment of the present inventive concept.

The display apparatus and the method of driving the display panel according to the present embodiment is substantially the same as the display apparatus and the method of driving the display panel of the previous embodiment explained referring to FIGS. 1 to 18 except for the structure and the operation of the driving controller. Thus, the same reference numerals will be used to refer to the same or like parts as those described in the previous embodiment of FIGS. 1 to 18 and any repetitive explanation concerning the above elements will be omitted.

Referring to FIGS. 1, 3 to 18 and 20 to 23, the display apparatus includes a display panel 100 and a display panel driver. The display panel driver includes a driving controller 200, a gate driver 300, a gamma reference voltage generator 400 and a data driver 500.

The driving controller 200 may determine a gain reducing area based on an edge load of the input image data IMG corresponding to an edge area of the display panel 100. The driving controller 200 may compensate the grayscale value of the input image data based on the gain reducing area to generate the data signal DATA. The gain reducing area may refer to an area in which a gain less than one is applied to the grayscale value (or the luminance) of the input image data IMG to reduce the grayscale value (or the luminance) of the input image data IMG.

The driving controller 200 may determine a minimum gain applied to an outermost display block based on an edge motion amount of the input image data IMG corresponding to a motion edge area MEA of the display panel 100. The driving controller 200 may compensate a grayscale value of the input image data IMG using the minimum gain to generate the data signal DATA. An area considered to determine the edge motion amount may be the motion edge area MEA of the display panel 100. An area not considered to determine the edge motion amount is a central area MCA of the display panel 100 surrounded by the motion edge area MEA.

For example, the driving controller 200 may include an edge load calculator 210 calculating the edge load of the input image data IMG corresponding to the edge area of the display panel 100 and a gain reducing area determiner 220 determining the gain reducing area based on the edge load.

For example, the driving controller 200 may include a edge motion amount calculator 240 calculating the edge motion amount of the input image data IMG corresponding to the motion edge area MEA of the display panel 100, a minimum gain determiner 250 determining the minimum gain applied to the outermost display block based on the edge motion amount and a compensator compensating the grayscale value of the input image data IMG using the gain reducing area and the minimum gain.

In FIG. 4, the gain reducing area may be defined by gain reducing start points disposed at first positions and second positions in axes.

For example, the gain reducing area may be defined by a first gain reducing start point x1 disposed at a first position in a first axis (an x-axis), a second gain reducing start point x2 disposed at a second position in the first axis (the x-axis), a third gain reducing start point y1 disposed at a first position in a second axis (a y-axis) crossing the first axis (the x-axis) and a fourth gain reducing start point y2 disposed at a second position in the second axis (the y-axis).

For example, the gain reducing area may be defined by the first to fourth gain reducing start points x1, x2, y1 and y2, a fifth gain reducing start point z1 disposed at a first position in a third axis (a first diagonal axis) crossing the first axis (the x-axis) and the second axis (the y-axis), a sixth gain reducing start point z2 disposed at a second position in the third axis (the first diagonal axis), a seventh gain reducing start point z3 disposed at a first position in a fourth axis (a second diagonal axis) crossing the first axis (the x-axis), the second axis (the y-axis) and the third axis (the first diagonal axis), and an eighth gain reducing start point z4 disposed at a second position in the fourth axis (the second diagonal axis).

Similar to the explanation in FIG. 4, the driving controller 200 may determine a first minimum gain in a first position in an x-axis, a second minimum gain in a second position in the x-axis, a third minimum gain in a first position in a y-axis, a second minimum gain in a second position in the y-axis, a fifth minimum gain in a first position in a first diagonal axis, a sixth minimum gain in a second position in the first diagonal axis, a seventh minimum gain in a first position in a second diagonal axis and an eighth minimum gain in a second position in the second diagonal axis.

The edge motion amount may correspond to a difference between a sum of loads of the input image data IMG corresponding to the motion edge area MEA in an N−1-th frame and a sum of loads of the input image data IMG corresponding to the motion edge area MEA in an N-th frame.

Alternatively, the edge motion amount may correspond to a sum of differences between display block loads of the input image data IMG corresponding to display blocks in the motion edge area MEA in the N−1-th frame and display block loads of the input image data IMG corresponding to the display blocks in the motion edge area MEA in the N-th frame.

As shown in FIG. 9, as the edge load of the input image data IMG increases, the size of the gain reducing area may be decreased. When the edge load is great, it means that a visibility of the edge area is great. Thus, when the edge load is great, it is preferable to reduce the size of the gain reducing area. In contrast, when the edge load is low, it means that a visibility of the edge area is low. Thus, when the edge load is low, it is preferable to enlarge the size of the gain reducing area.

As shown in FIG. 21, as the edge motion amount MOTION AMOUNT of the input image data IMG increases, the minimum gain may be decreased. When the edge motion amount MOTION AMOUNT is low, it means that a visibility of the edge area is great. Thus, when the edge motion amount MOTION AMOUNT is low, it is preferable not to reduce the minimum gain much. In contrast, when the edge motion amount MOTION AMOUNT is great, it means that a visibility of the edge area is low. Thus, when the edge motion amount MOTION AMOUNT is great, the minimum gain may be reduced relatively much.

In the present embodiment, the edge area (e.g. an area except for CFA in the display panel of FIG. 11) for determining the gain reducing area may be different from the motion edge area (MEA in FIG. 20) for determining the edge motion amount.

For example, the edge area (e.g. an area except for CFA in the display panel of FIG. 11) may be greater than the motion edge area (MEA in FIG. 20). The edge area (e.g. an area except for CFA in the display panel of FIG. 11) for applying the gain reduction may be preferable to be greater than the motion edge area (MEA in FIG. 20) for determining the edge motion amount. If the edge area (e.g. an area except for CFA in the display panel of FIG. 11) for applying the gain reduction is too small, the effect of preventing logo afterimage by the gain reduction may be limited.

For example, the edge area may include four display blocks at each of both ends in the x-axis and four display blocks at each of both ends in the y-axis in FIG. 11. The motion edge area may include two display blocks at each of both ends in the x-axis and two display blocks at each of both ends in the y-axis in FIG. 20.

According to the present embodiment, the size of the gain reducing area may be adjusted according to the load of the input image data IMG corresponding to the edge area of the display panel 100. In addition, the size of the gain reducing area may be determined based on a plurality of axes so that a shape of the gain reducing area may vary according to the load of the input image data IMG.

In addition, the minimum gain corresponding to the outermost block of the edge area of the display panel 100 may vary according to the amount of the motion of the input image data IMG corresponding to the edge area.

The size of the gain reducing area and the minimum gain may be determined based on the load and the amount of the motion of the input image data IMG corresponding to the edge area of the display panel 100 so that the edge area of the display panel 100 may be properly compensated. Accordingly, the afterimage due to the logo displayed in the edge area may be reduced. Thus, the display quality of the display panel 100 may be enhanced.

According to the display apparatus and the method of driving the display panel in the present inventive concept, the afterimage due to the logo displayed in the edge area may be reduced so that the display quality of the display panel may be enhanced.

The foregoing embodiments are not to be construed as limiting the present inventive concepts. Those skilled in the art will appreciate that many modifications are possible without materially departing from the novel teachings and advantages of the present inventive concepts. Accordingly, the scope of the invention is defined by the appended claims.

What is claimed is:

1. A display apparatus comprising:

a display panel;

a driving controller; and a data driver, such that in operation the driving controller determines a gain reducing area based on an edge load of input image data corresponding to an edge area of the display panel and compensates a grayscale value of the input image data corresponding to the gain reducing area to generate a data signal, and the data driver converts the data signal to a data voltage and outputs the data voltage to the display panel.

2. The display apparatus of claim 1, wherein the gain reducing area is defined by gain reducing start points disposed at a first position and a second position in an axis.

3. The display apparatus of claim 2, wherein the gain reducing area is defined by a first gain reducing start point disposed at a first position in a first axis, a second gain reducing start point disposed at a second position in the first axis, a third gain reducing start point disposed at a first position in a second axis crossing the first axis and a fourth gain reducing start point disposed at a second position in the second axis.

4. The display apparatus of claim 3, wherein the gain reducing area is defined by the first to fourth gain reducing start points, a fifth gain reducing start point disposed at a first position in a third axis crossing the first axis and the second axis, a sixth gain reducing start point disposed at a second position in the third axis, a seventh gain reducing start point disposed at a first position in a fourth axis crossing the first axis, the second axis and the third axis, and an eighth gain reducing start point disposed at a second position in the fourth axis, and wherein the first axis is parallel to a first side of the display panel, the second axis is parallel to a second side of the display panel, the third axis extends in a first diagonal line direction of the display panel, and the fourth axis extends in a second diagonal line direction of the display panel.

5. The display apparatus of claim 2, wherein the driving controller is configured to determine a display block having a load less than a threshold from a first end outermost display block in a first end edge area disposed at a first end portion of the axis, wherein the driving controller is configured to determine first continuous display blocks that have loads less than the threshold from the first end outermost display block, and wherein an innermost display block in the first continuous display blocks is determined as the gain reducing start point at the first position of the axis.

6. The display apparatus of claim 5, wherein the driving controller is configured to determine a display block having a load less than the threshold from a second end outermost display block in a second end edge area disposed at a second end portion of the axis, wherein the driving controller is configured to determine second continuous display blocks that have loads less than the threshold from the second end outermost display block, and wherein an innermost display block in the second continuous display blocks is determined as the gain reducing start point at the second position of the axis.

7. The display apparatus of claim 1, wherein as the edge load of the input image data increases, a size of the gain reducing area is decreased.

8. The display apparatus of claim 1, wherein in operation the driving controller determines a minimum gain applied to an outermost display block based on an edge motion amount of the input image data corresponding to a motion edge area of the display panel and to compensate the grayscale value of the input image data using the gain reducing area and the minimum gain to generate the data signal.

9. The display apparatus of claim 8, wherein the edge motion amount corresponds to a difference between a sum of loads of the input image data corresponding to the motion edge area in an N−1-th frame and a sum of loads of the input image data corresponding to the motion edge area in an N-th frame, and wherein N is a positive integer greater than two.

10. The display apparatus of claim 9, wherein as the edge motion amount of the input image data increases, the minimum gain is decreased.

11. The display apparatus of claim 8, wherein the edge area for determining the gain reducing area is different from the motion edge area for determining the edge motion amount.

12. The display apparatus of claim 11, wherein the edge area is greater than the motion edge area.

13. A display apparatus comprising:

a display panel;

a driving controller; and a data driver configured to, such that in operation the driving controller determines a minimum gain applied to an outermost display block based on an edge motion amount of input image data corresponding to a motion edge area of the display panel and compensates a grayscale value of the input image data using the minimum gain to generate a data signal, and the data driver converts the data signal to a data voltage and outputs the data voltage to the display panel.

14. The display apparatus of claim 13, wherein the edge motion amount corresponds to a difference between a sum of loads of the input image data corresponding to the motion edge area in an N−1-th frame and a sum of loads of the input image data corresponding to the motion edge area in an N-th frame, and wherein N is a positive integer greater than two.

15. The display apparatus of claim 14, wherein as the edge motion amount of the input image data increases, the minimum gain is decreased.

16. A method of driving a display panel, the method comprises:

calculating an edge load of input image data corresponding to an edge area of the display panel;

determining a gain reducing area based on the edge load;

compensating a grayscale value of the input image data corresponding to the gain reducing area to generate a data signal; and converting the data signal to a data voltage.

17. The method of claim 16, wherein the gain reducing area is defined by gain reducing start points disposed at a first position and a second position in an axis.

18. The method of claim 16, wherein as the edge load of the input image data increases, a size of the gain reducing area is decreased.

19. The method of claim 16, further comprising:

calculating an edge motion amount of the input image data corresponding to a motion edge area of the display panel; and determining a minimum gain applied to an outermost display block based on the edge motion amount, wherein the grayscale value of the input image data is compensated using the gain reducing area and the minimum gain to generate the data signal.

20. The method of claim 19, wherein as the edge motion amount of the input image data increases, the minimum gain is decreased.

* * * * *